US006929465B1

(12) United States Patent
Graham et al.

(10) Patent No.: US 6,929,465 B1
(45) Date of Patent: Aug. 16, 2005

(54) TIMER CIRCUIT FOR VALVE ACTIVATION IN OIL BURNER SYSTEM

(75) Inventors: John P. Graham, Elyria, OH (US); Victor J. Turk, Elyria, OH (US)

(73) Assignee: R. W. Beckett Corporation, North Ridgeville, OH (US)

( * ) Notice: Subject to any disclaimer, the term of this patent is extended or adjusted under 35 U.S.C. 154(b) by 61 days.

(21) Appl. No.: 10/067,012

(22) Filed: Feb. 4, 2002

(51) Int. Cl.[7] ..... F23N 5/20
(52) U.S. Cl. ..... 431/29; 431/67; 431/73
(58) Field of Search ..... 431/18, 29, 30, 431/31, 67, 72, 73

(56) References Cited

U.S. PATENT DOCUMENTS

| | | | | |
|---|---|---|---|---|
| 3,365,624 A | * | 1/1968 | Komendera | 361/198 |
| 3,832,123 A | * | 8/1974 | Walbridge | 431/78 |
| 3,906,294 A | * | 9/1975 | Lourigan | 361/196 |
| 4,021,155 A | | 5/1977 | Erikson et al. | |
| 4,145,179 A | | 3/1979 | Tanaka et al. | |
| 4,257,759 A | | 3/1981 | Miles | |
| 4,270,561 A | | 6/1981 | Bjorklund | |
| 4,325,689 A | * | 4/1982 | Burke | 431/70 |
| 4,388,064 A | | 6/1983 | Kaplan et al. | |
| 4,544,349 A | * | 10/1985 | Nakamura et al. | 431/30 |
| 4,737,101 A | | 4/1988 | Palmer | |
| 4,746,823 A | | 5/1988 | Lee | |
| 5,384,505 A | | 1/1995 | Takahashi | |
| 5,563,758 A | | 10/1996 | Dembrosky et al. | |
| 5,910,744 A | | 6/1999 | Watarai | |

FOREIGN PATENT DOCUMENTS

FR 2 616 210 A1 * 12/1988 ..... F23D/11/24

OTHER PUBLICATIONS

"Unijunction Transistor", American Microsemiconductor, reprinted from the Internet at: http://www.americanmicrosemi.com/tutorials/unijunction.htm, Jan. 9, 2002, 2 pages.

"Measuring Temperature with Thermistors—a Tutorial", National Instruments Corporation, David Potter, Application Note 065, Jun., 1995, 8 pages.

"Unijunction Transistors", Matthew H. Williams, reprinted from the Internet at: http://members.tripod.com/ baec/ DEC90/uni_tran.htm, Jan. 9, 2002, 5 pages.

* cited by examiner

*Primary Examiner*—Josiah C. Cocks
(74) *Attorney, Agent, or Firm*—Eschweiler & Associates LLC

(57) ABSTRACT

The present invention is directed to an oil burner system having an electric cord set coupled between a controller and a valve associated with a pump. The electric cord set is operable to activate a solenoid valve associated with the pump for delivery of fuel oil to a nozzle of the burner. The electric cord set comprises a voltage or temperature independent timer circuit operable to activate the solenoid valve a predetermined period of time after a call for ignition signal is generated by the controller, wherein the predetermined time period is substantially constant with respect to variations in line voltage or in an ambient temperature in which the oil burner system resides.

13 Claims, 12 Drawing Sheets

TIMER CIRCUIT FOR VALVE ACTIVATION IN OIL BURNER SYSTEM

FIELD OF THE INVENTION

The present invention relates generally to oil burner systems, and more particularly to a timer circuit and associated method for delivering fuel oil to a nozzle for combustion thereof after a predetermined time period that is substantially independent of line voltage, frequency and/or temperature.

BACKGROUND OF THE INVENTION

Oil burners are employed in various types of apparatus, such as boilers, furnaces, water heaters, etc. In such applications, an oil burner receives a fuel oil and initiates combustion thereof to generate heat which is then employed in various manners to perform work. Although several types of oil burners exist, one exemplary oil burner is illustrated in prior art FIG. 1, and is designated at reference numeral 10. The oil burner 10 comprises a blower housing 12 having an air tube 14 extending therefrom. The air tube 14 contains a combustion head affixed or positioned at one end 16 of the air tube opposite the housing 12, the end 16 having a nozzle and electrode assembly (not shown) positioned thereat. The nozzle is coupled to a fuel pump 18 by a fuel or nozzle line (a portion of which is highlighted at 20) for delivery of fuel oil thereto. The electrode assembly in the air tube 14 is coupled to a transformer or other type ignition device 22 residing on a top portion 24 of the housing 12.

As seen in prior art FIG. 2, the fuel pump 18 is axially driven by a drive shaft 26 associated with a motor 28 located on an opposite face 30 of the housing 12. The drive shaft 26 also drives a blower wheel 32 within the housing 12 for providing air into the air tube 14 for combustion via an air inlet portion 33 in the housing 12. The motor 28 is controlled by an electronic control module 34. The electronic control 34 operates to initiate delivery of oil, air and spark to the ignition head at 16 based on a call for heat from a thermostat (not shown), for example. The controller 34 may also operate to re-initiate ignition if combustion is discontinued unexpectedly and may further discontinue delivery of oil to the nozzle if ignition cannot be re-established within a predetermined lock-out time period (sometimes referred to as a safety lock-out condition).

Various types of controllers exist for oil burners. The controller 34 illustrated in prior art FIGS. 1 and 2 represents one basic type of controller that is used extensively. The controller 34 initiates air flow and fuel delivery substantially simultaneously via the motor drive shaft, while concurrently initiating spark at the head via a signal to the transformer 22. The above control methodology works well in many instances, however, since a fuel pressure at the nozzle during start-up may be less than the intended pressure, sufficient atomization of the fuel oil may not be established at start-up for robust combustion (i.e., a "rough" start). Accordingly, some control methodologies have adjusted the above procedure to improve combustion commencement by delaying the delivery of fuel to the nozzle until such time as the air flow has stabilized and the fuel pressure within the pump 18 has increased to near its steady state operating pressure. Such a delay is typically accomplished by a hydraulic valve circuit (not shown) within the fuel pump 18 or by a solenoid valve 19 having a valve activation which is delayed for a period of time after the air delivery and fuel pump are activated.

Since many of the basic style controllers highlighted above are in the field and operating adequately, replacement of the controller 34 with a more sophisticated controller having a timing delay therein incurs the cost of replacement of the controller, and thus in some cases is prohibitively expensive. Accordingly, use of a solenoid valve has been employed in various instances with a basic type controller. An external solenoid valve is typically mounted on the housing 12, typically near or on the pump 18 and is undesirably more complex and more costly than the standard arrangement. Furthermore, there may be interferences between the valve mounting and other necessary features of the burner, such as main power cordset routing. In addition, the valve undesirably takes space which is of concern because many burner units 10 are covered with an enclosure for safety and/or aesthetic reasons, and such additional space may impact the enclosure being employed.

One prior art solution to the above problem has been to integrate the solenoid valve into the pump and employ a negative temperature coefficient (NTC) current limiting device such as a thermistor within a connecting plug between the controller 34 and valve portion of the fuel pump 18 that allows an increasing amount of electric current to flow into the solenoid coil as the thermistor device heats up until the solenoid stem is actuated.

Although the prior art solutions have proven effective in many instances, it is always desirable to further improve delay systems for delivery of fuel oil to the nozzle for purposes of ignition.

SUMMARY OF THE INVENTION

The following presents a simplified summary in order to provide a basic understanding of some aspects of the invention. This summary is not an extensive overview of the invention. It is intended to neither identify key or critical elements of the invention nor delineate the scope of the invention. Rather, the primary purpose of this summary is to present some concepts of the invention in a simplified form as a prelude to the more detailed description that is presented later.

The present invention relates to an oil burner system having an electric cord set coupled between a controller and a valve associated with a pump. The electric cord set is operable to activate a solenoid valve associated with the pump and comprises a substantially voltage, frequency and/or temperature independent timer circuit operable to activate the solenoid valve a predetermined period of time after a call for ignition signal is generated by the controller. The predetermined time period represents a delay period which is substantially constant with respect to variations in line voltage or in an ambient temperature in which the oil burner system resides.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
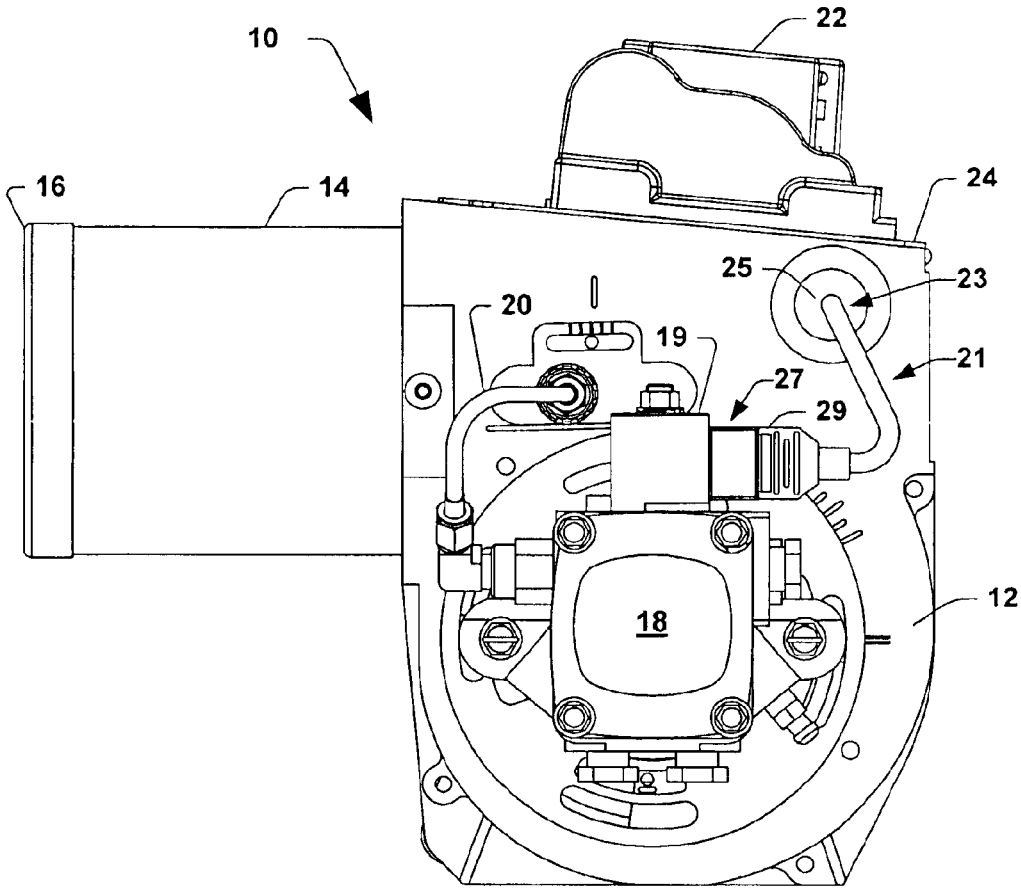
FIG. 1 (PRIOR ART)
FIG. 1 is a prior art side elevation view of an oil burner and various burner components associated therewith.

The present invention will now be described with respect to the accompanying drawings in which like numbered elements represent like parts. The present invention is directed to an oil burner system that employs a timer circuit to delay delivery of fuel oil to the burner nozzle upon a call for ignition. The delay provided by the timer circuit is substantially independent of variations in line voltage and/or temperature and therefore provides aid in providing consistent quality ignition commencement.

As discussed above, one form of prior art controller methodology utilized a thermistor within a cord set used between the controller 34 and a valve associated with the pump 18. As is well known, a thermistor is typically a semiconductor device that exhibits a resistance that is a function of temperature. In particular, NTC thermistors exhibit a resistance that decreases with temperature. In many applications, NTC thermistors are used as temperature sensors, however, in prior art oil burner systems, a self-heating property of a thermistor is exploited in order to utilize the thermistor as a timer.

In particular, at an initial time when a controller calls for heat, a current is passed through the thermistor, causing power to be dissipated therein in accordance with $P=I^2R$, thereby causing the thermistor to self-heat. As the thermistor temperature increases, the resistance thereof decreases due to the negative temperature coefficient associated therewith. At some point in time (defining a delay time), the resistance of the thermistor drops sufficiently to activate or otherwise trigger the solenoid valve associated with the pump, at which point the pump delivers oil to the oil burner nozzle at the head of the burner through the nozzle line. Thus the delivery of oil to the head of the burner is delayed by a period of time after a call for heat is provided by the controller, and the delay time is dictated by the self-heating of the thermistor.

The inventors of the present invention appreciated that the above prior art solution suffers from several drawbacks. Initially, appliances that utilize oil burners are subject to widely varying external ambient temperature conditions; for example, a burner installed outside in the New England area may reside at about −10° F. at the initiation of combustion, while a burner installed inside a restricted ventilation environment in a furnace after several combustion cycles may reside in an ambient environment at up to about 150° F. prior to another call for heat. Since the thermistor resides in a cordset local to the pump, the thermistor exhibits an initial temperature associated with the surrounding ambient.

The inventors of the present invention appreciated that since the time delay period is dictated by the time it takes the thermistor to decrease in resistance due to self-heating sufficiently to trigger the solenoid valve, the variations in ambient temperature greatly impact the time delay period. For example, when the delay is extremely short when the ambient temperature is extremely warm (e.g., less than about two (2) seconds), insufficient delay may exist and air flow may not have sufficiently stabilized and insufficient fuel pressure may exist when the solenoid valve is actuated, thereby resulting in a "rough" start. In contrast, if the delay becomes too long, for example, when the ambient temperature is extremely low (cold), the delay can extend beyond the safety lock-out time, resulting undesirably in a lock-out condition where the controller shuts off the system because ignition is not being initiated within a predetermined lock-out time. In such a condition, the burner system shuts down because the controller incorrectly concludes that ignition cannot be established due to a component failure.

Figure 3:
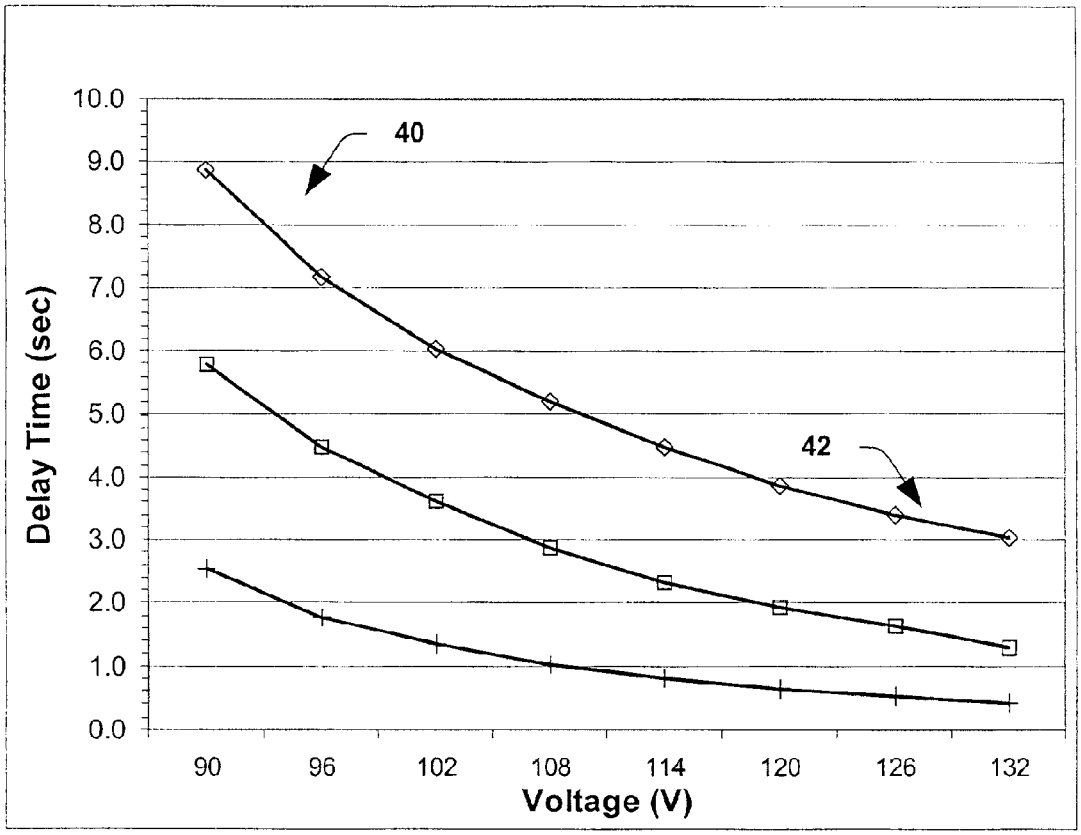
FIG. 3 (PRIOR ART)
FIG. 3 is a graph illustrating variations in delay time associated with prior art timers due to variations in line voltage.

In addition, the inventors of the present invention appreciated that the thermistor delay time period was also a substantial function of the line voltage. In the field, oil burner systems are typically powered by the AC line voltage provided in that area by the power supplier. Such line voltage, however, varies greatly depending on the geographic location of the system. For example, oil burner systems in some regions of Newfoundland have been found to receive a line voltage of as much as about 140V, while oil burner systems in Long Island may receive a line voltage as low as 105V or less. For example, various types of delay valve arrangements were tested over a range of line voltages, and the variation in delay timing with respect to line voltage is illustrated in the graph of FIG. 3. Note that for low line voltages at 40, delay times are about three or more times greater than for higher line voltages at 42. Therefore the inventors of the present invention, appreciating the problems associated with the prior art, disclose a timer circuit which may be integrated into a cord set between a controller and valve associated with the pump that provides a delay time which is substantially independent of temperature and/or line voltage. Consequently, the delay time is sufficiently long to ensure an efficient combustion initiation, without concern that the delay time will extend beyond a safety lock-out time and cause a lock-out condition.

Figure 4:
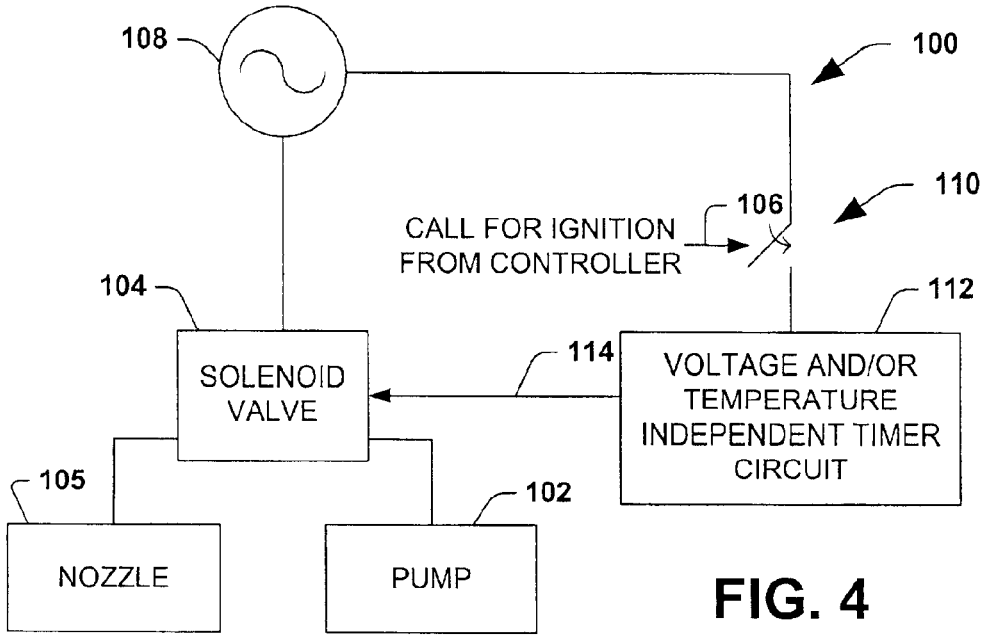
FIG. 4 is a block diagram illustrating a solenoid valve actuated by a voltage and/or temperature independent timer circuit according to one aspect of the present invention.

Turning now to FIG. 4, a block diagram is provided illustrating a fuel delivery system 100 for use within an oil burner system that generates a delay time which is substantially independent of variations in temperature and/or line voltage. In accordance with one example, the circuit 100 may be employed within a cordset that connects the oil burner controller (not shown) to a fuel oil pump 102. In such an example, a solenoid valve 104 is associated with the pump 102 and operates to enable/disable the delivery of fuel oil from the pump 102 to a nozzle 105 at the combustion head via a nozzle line (not shown).

Using a cordset, a call for ignition signal 106 from the controller serves to initiate a motor (not shown) that drives a shaft of the fuel pump 102, thereby establishing a sufficient fuel pressure therein. The ignition signal 106 also may couple the solenoid valve 104 either directly to the line voltage or to a voltage 108 associated with the line voltage. Lastly, the call for ignition signal 106 from the controller also couples power 108 to a voltage and/or temperature independent timer circuit 112 via a switch 110, for example. The use of the invention 100 in a cordset allows use of a solenoid valve 104 that is integrated with the pump 102, and thus removes the need for a separate, externally mounted solenoid valve and external timer. The present invention, however, is not limited to such arrangements.

Figure 2:
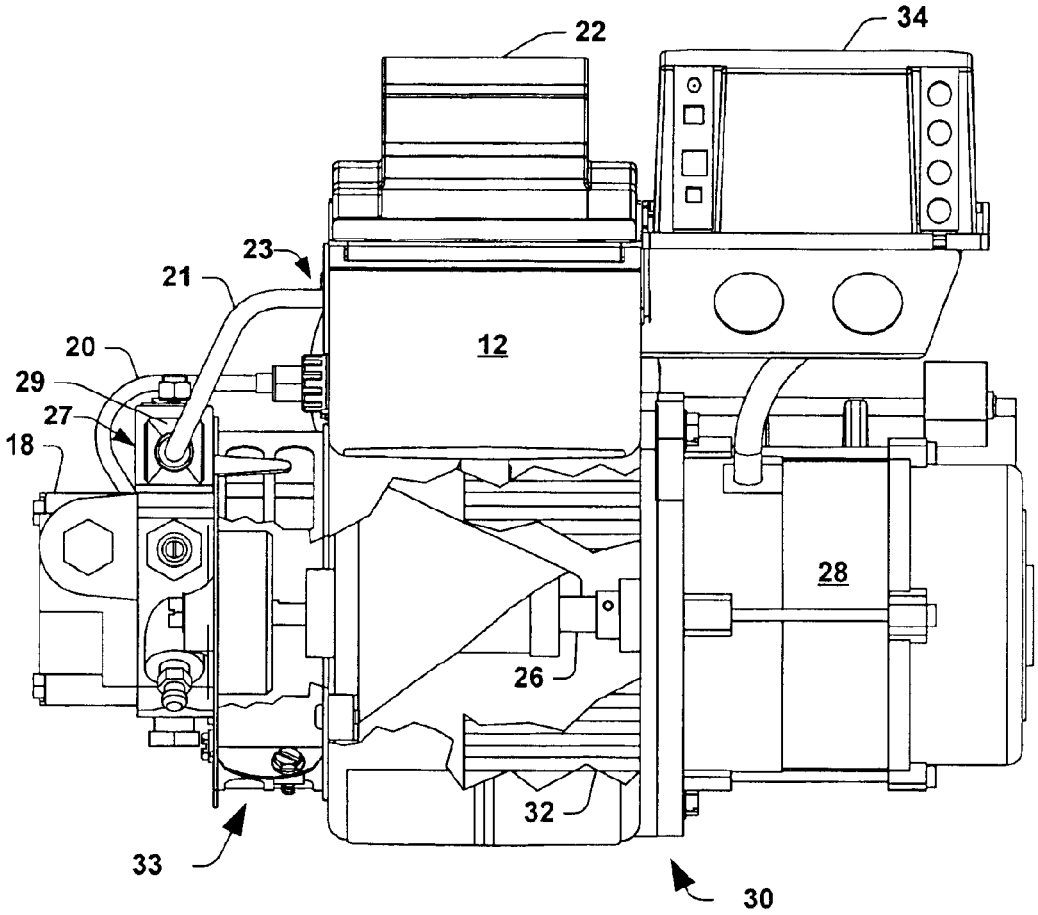
FIG. 2 (PRIOR ART)
FIG. 2 is a rear elevation view of the oil burner of FIG. 1 illustrating various burner components associated therewith.

Referring briefly to prior art FIGS. 1 and 2 for purposes of appreciating the context of the present invention, a cordset 21 resides on the oil burner 10 and couples between the controller 34 and the valve 19 that may be either an external solenoid valve (as illustrated) or a valve residing within the pump 18. The cordset 21 has a first end 23 that passes through an aperture portion 25 of the housing 12 and electrically connects to the controller 34 (e.g., using wire nuts or other electrical coupling mechanisms), and a second end 27 that includes a plug housing portion 29 (e.g., either male or female) that plugs into the valve 19 (or the pump 18 if the valve resides therein). As stated above, the circuit 100 of the present invention resides within the cordset 21, for example, within the plug housing portion 29 thereof. By residing within the cordset 21, the circuit 100 advantageously avoids increasing the footprint of the oil burner system.

The voltage and/or temperature independent timer circuit 112 of FIG. 4 operates to generate a delay time between the call for ignition 106 and a control signal 114 that activates the solenoid valve 104. Therefore in accordance with one aspect of the present invention, a call for ignition signal 106 concurrently activates the switch 110 and the timer circuit 112. However, despite variations in the line voltage 108 or the ambient temperature in which the oil burner system resides, a timing in which the control signal 114 activates the solenoid valve 104 for delivery of fuel by the pump 102 is generally constant, thereby overcoming the problems and disadvantages associated with the prior art.

Figure 5:
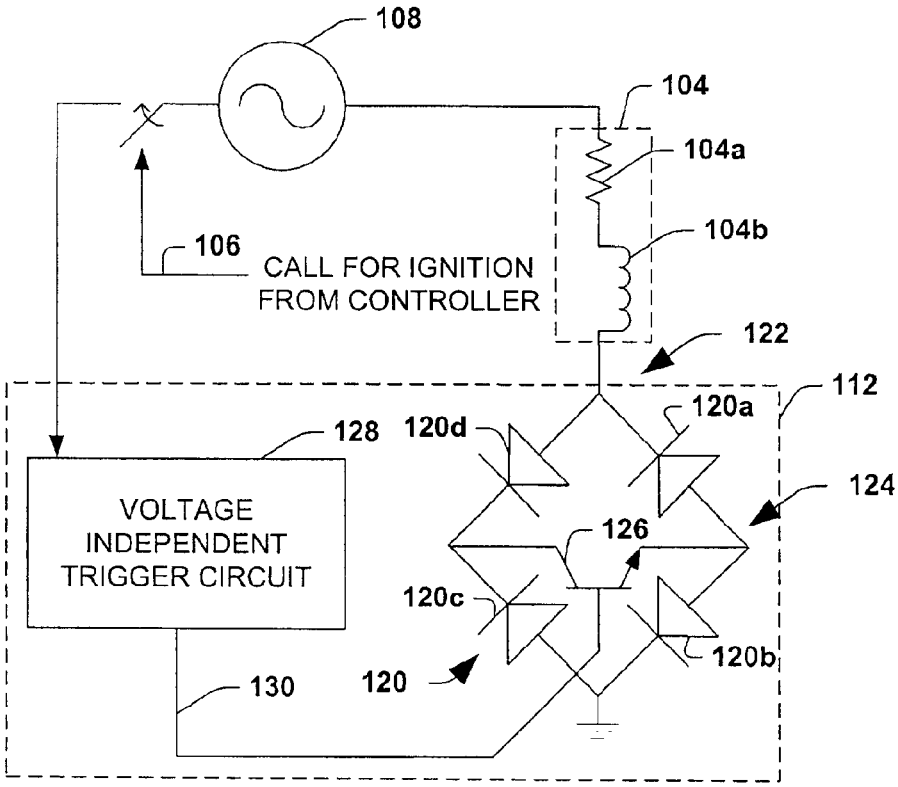
FIG. 5 is a combined block and schematic diagram illustrating a solenoid actuated by a timer circuit having a voltage independent trigger circuit according to another aspect of the present invention.

Turning now to FIG. 5, a combined block and schematic diagram is provided in which an exemplary solenoid valve 104 and a timer circuit 112 are provided in greater detail in accordance with another aspect of the present invention. For example, the solenoid valve 104 may be modeled as a resistance 104*a* in series with an inductance 104*b* and is coupled to the timer circuit 112 through a bridge circuit 120. The bridge circuit 120 comprises four diodes 120*a*–120*d* configured to form a full wave rectifier bridge circuit. On an AC side 122 of the bridge 120, the sinusoidal line voltage is supplied through the solenoid valve 104 (differing slightly from FIG. 4). On a DC side 124 of the bridge 120, a transistor 126 or other type switching device prevents flow of current through the bridge 120 until the transistor 126 is activated or turned on. The transistor 126 is controlled by a voltage and/or temperature independent trigger circuit 128 (illustrated in FIG. 5 solely as a line voltage independent trigger circuit).

In accordance with one aspect of the present invention, a call for ignition signal 106 either directly or indirectly activates the trigger circuit 128 which generates a control signal 130 to the control terminal of the transistor 126 after a predetermined period of time, wherein the time period is substantially independent of variations in ambient temperature and/or line voltage. Accordingly, the control signal 130 activates or otherwise turns on the transistor 126, causing current to conduct through the bridge 120 and activating the solenoid valve 104. The activation of the solenoid valve 104 causes fuel oil to be delivered to the nozzle via the fuel pump 102 (not shown).

Figure 6:
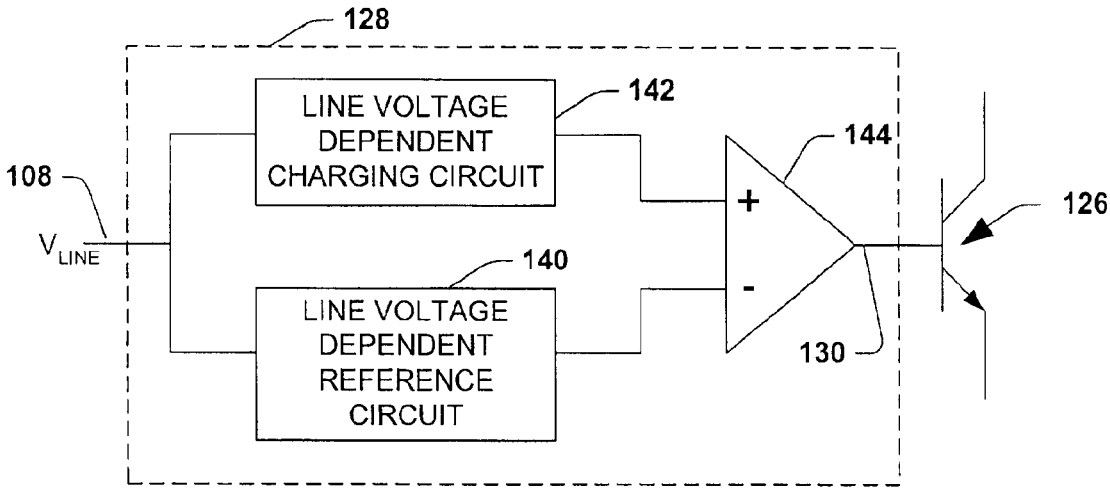
FIG. 6 is a combined block and schematic diagram illustrating a substantially voltage independent trigger circuit according to another aspect of the present invention.

In accordance with another aspect of the invention, exemplary details of the line voltage and/or temperature independent trigger circuit 128 are illustrated in FIG. 6. In accordance with the example of FIG. 6, the trigger circuit 128 comprises a reference circuit 140 and a charging circuit 142, which are both input to a comparator circuit 144. The comparator circuit 144 is operable to compare voltage levels with respect to the circuits 140 and 142, respectively, and output the control signal 130 in response thereto. As discussed previously, the control signal 130 may be employed to drive a switch 126 such as a base terminal of an NPN type bipolar transistor, as illustrated.

In the example of FIG. 6, the reference voltage circuit 140 is operable to receive power, for example, via the line voltage, and output a voltage that is a function of the line voltage at a first input 146 of the comparator circuit 144. The charging circuit 142 is operable upon activation, for example, via application of the line voltage thereto, to charge an output node 148 from a first voltage potential to a second voltage potential, wherein the second potential is greater than the reference voltage at 146. The output node 148 is coupled to a second input of the comparator circuit 144. When the charging voltage at the node 148 exceeds the reference voltage 146, the comparator 144 switches and the output 130 transitions from one voltage level to another level, for example, transitioning from a low level state to a high level state to thereby activate the transistor 126.

The delay of the trigger circuit 128 is a function of the time it takes the charging circuit 142 to increase to a voltage potential that exceeds the reference voltage provided by the reference circuit 140. In accordance with one aspect of the present invention, the reference voltage provided by the circuit 140 is a function of the line voltage while the charging rate at the output node 148 of the charging circuit 142 is also a function of the line voltage. Preferably, both outputs 146 and 148 are both either positive or negative functions of the line voltage, respectively, so that as one of the variables being compared changes with respect to the line voltage, the other variable changes in a similar manner.

More preferably, both variables are direct functions of line voltage, wherein, for example, if the reference voltage increases substantially due to an increase in line voltage, the charging rate of the output node 148 increases sufficiently so that the comparator 144 switches at about the same time as the circuit 128 at a lower line voltage.

Figure 7:
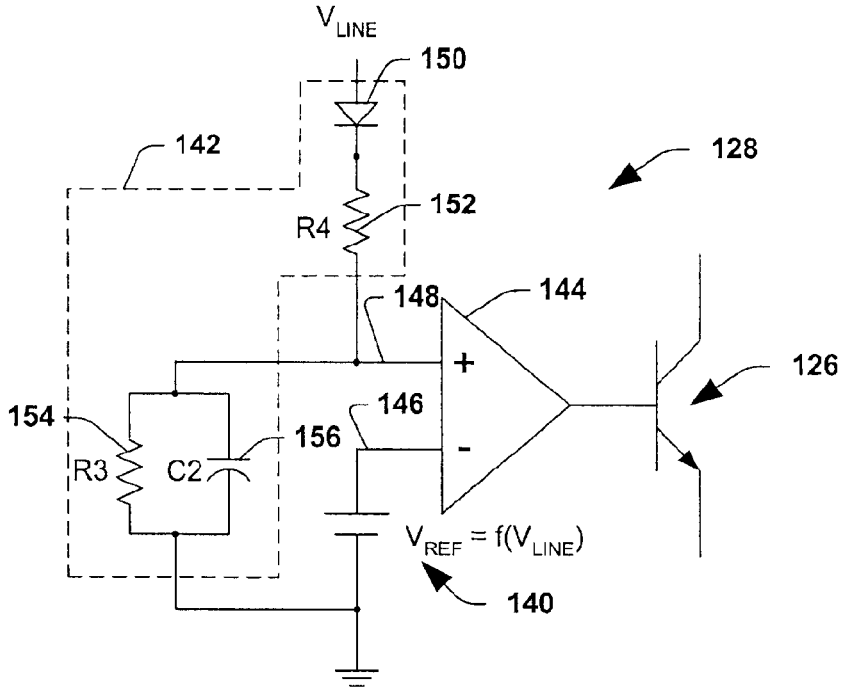
FIG. 7 is a schematic diagram illustrating the charging circuit of FIG. 6 in greater detail according to yet another aspect of the present invention.

An exemplary trigger circuit 128 is illustrated in greater detail in FIG. 7. In the above example, the charging circuit 142 comprises a diode 150 that receives the line voltage or a voltage associated therewith and provides half-wave rectified voltage to a series resistor $R_4$ 152, which couples to the input 148 of the comparator 144. A parallel RC network comprising a resistor $R_3$ 154 and a capacitor $C_2$ 156 are also coupled to the input 148, as well as to a circuit ground. If the half-wave rectified voltage at $R_4$ is approximated as a step voltage $V_1$, a voltage at node 148 may be characterized by the equation:

$$V_C(t) = \frac{R_1}{R_1 + R_2}\left(\frac{1}{\tau}\right)\left[1 - e^{-\left(\frac{t}{\tau}\right)}\right]V_1, \quad (1)$$

$$\text{where time constant } \tau = \frac{R_1 R_2 C_1}{R_1 + R_2}.$$

Therefore the rate of charging at node 148 is a function of the step voltage $V_1$, which is an approximation or function of the line voltage.

The reference voltage $V_{REF}$ at node 146 is also a function of the line voltage, and more preferably is a function of the line voltage in a manner similar to that highlighted above. Thus in the trigger circuit 128 of FIG. 7, a time period between when $V_{LINE}$ is applied thereto and the moment when the comparator circuit 144 trips is generally independent of variations in the line voltage. This substantially independent delay time period is then employed to activate the solenoid valve for delivery of fuel oil from the pump to the combustion head via the nozzle line.

Figure 8:
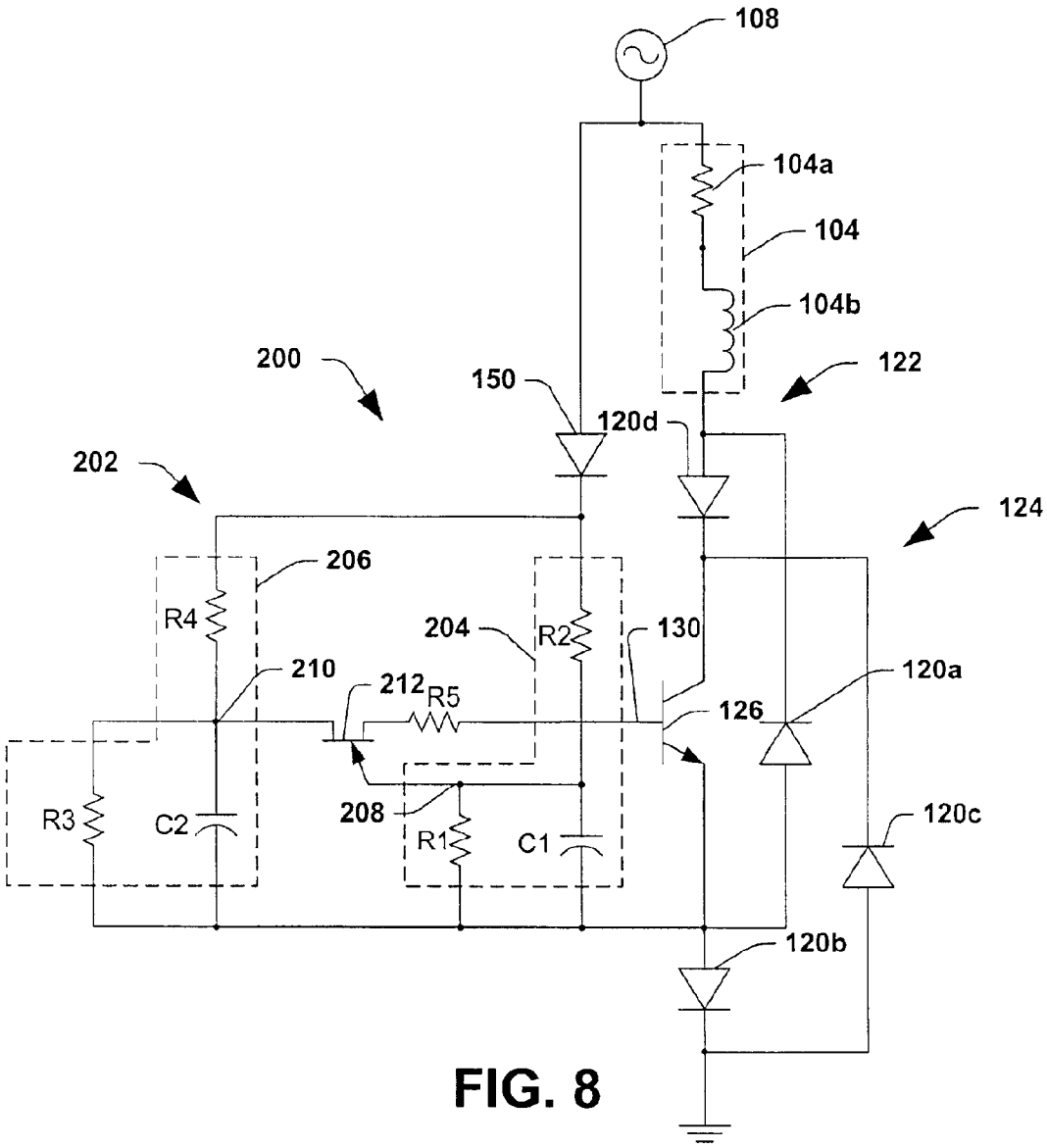
FIG. 8 is a schematic diagram of a timer circuit for use in an oil burner system that provides a delay time which is substantially independent of variations in line voltage and temperature according to still another aspect of the present invention.

In accordance with yet another aspect of the present invention, a timer circuit that is substantially independent of line voltage is disclosed in FIG. 8, and designated at reference numeral 200. The timer circuit 200 is coupled to the load, the solenoid valve 104, in a manner similar to that described supra, and is also coupled to a voltage 108 associated with the line voltage when a call for ignition signal is generated by the oil burner system controller. Similar to that described earlier, the sinusoidal voltage 108 associated with the line voltage is received at the AC side 122 of the bridge circuit 124, and a switch such as transistor 126 selectively allows current to conduct therethrough based on the control signal 130.

The circuit 200 further comprises a timer portion 202 having two RC type charging circuits 204 and 206, respectively. Each of the charging circuits 204 and 206 are coupled between the half-wave rectifying diode 150 and circuit ground through one of the diodes 120*b* of the bridge circuit. In addition, each of the charging circuits 204 and 206 have a charging node 210 and 208 which charge at a rate which is a function of the resistance and capacitance values therein, respectively. For example, if the half-wave rectified voltage at $R_2$ and $R_3$ is approximated as a step voltage $V_1$, a voltage ($V_{CA}(t)$) at node 210 may be characterized by the equation:

$$V_C A(t) = \frac{R_3}{R_3 + R_4}\left(\frac{1}{\tau A}\right)\left[1 - e^{-\left(\frac{t}{\tau A}\right)}\right]V_1, \quad (2)$$

-continued $$\text{where time constant } \tau A = \frac{R_3 R_4 C_2}{R_3 + R_4},$$

while a voltage ($V_{CB}(t)$) at node 208 is characterized by the equation:

$$V_C B(t) = \frac{R_1}{R_1 + R_2}\left(\frac{1}{\tau B}\right)\left[1 - e^{-\left(\frac{t}{\tau B}\right)}\right]V_1, \quad (3)$$

$$\text{where time constant } \tau B = \frac{R_1 R_2 C_1}{R_1 + R_2}.$$

Figure 9:
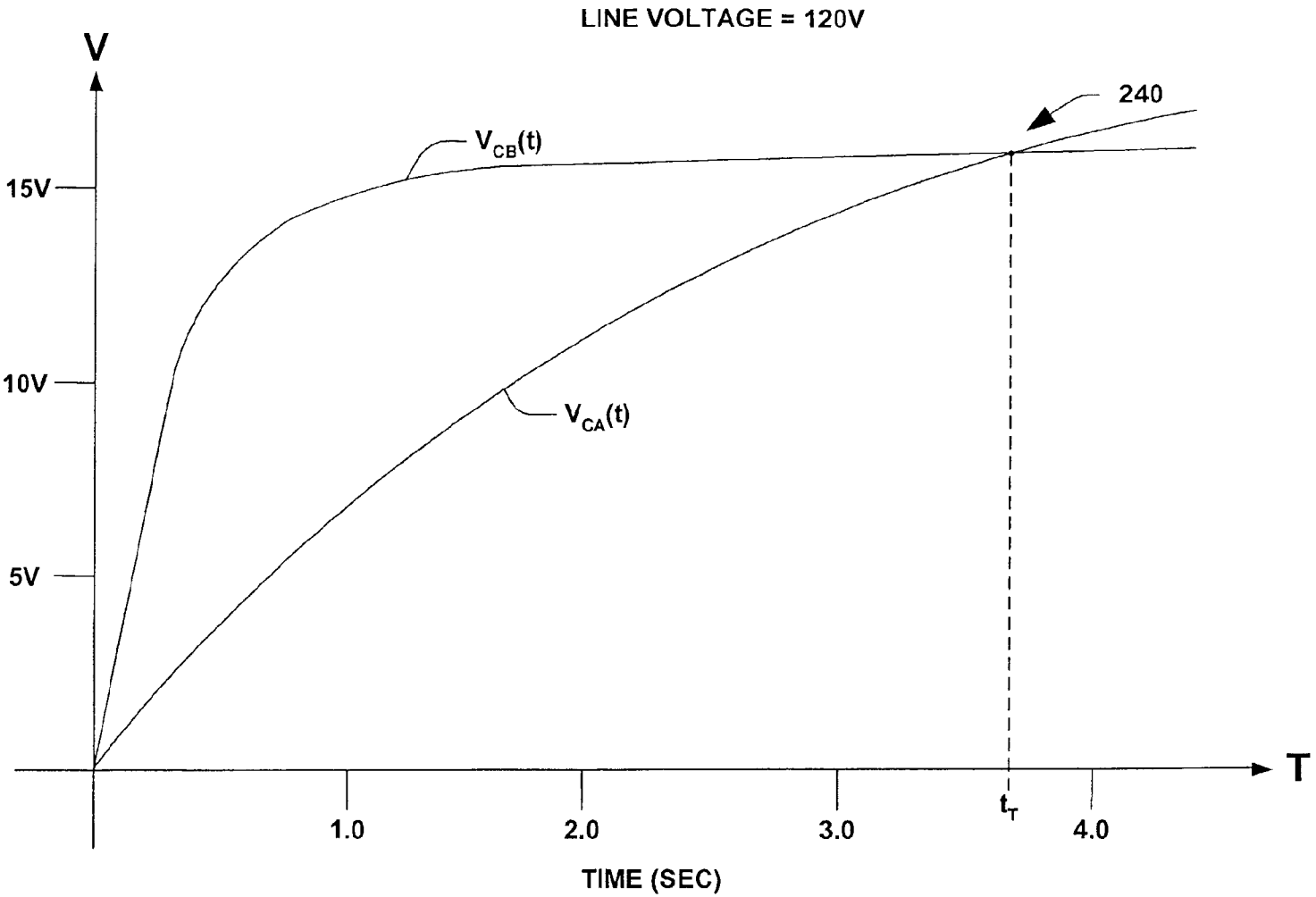
FIG. 9 is a graph illustrating signals on the output nodes of the two charging circuits of FIG. 8 for a 120V line voltage, and the delay time defined by when the signals are equal to one another according to the present invention.

If two such circuits 204 and 206 are connected in parallel to the same voltage source $V_1$ as illustrated in FIG. 8, the values of $R_1$, $R_2$, and $C_1$ of circuit 204 and $R_3$, $R_4$, and $C_2$ of charging circuit 206 may be selected so that the time constant $\tau_A$ of circuit 206 is greater than the time constant $\tau_B$ of circuit 204 and the steady state voltage $V_{CA}(t=\infty)$ is greater than the steady state voltage $V_{CB}(t=\infty)$. Accordingly, at some time $t_T$, the voltage curves $V_{CA}(t)$ and $V_{CB}(t)$ will cross, as illustrated in FIG. 9 at 240. At $t_T$, $V_{CA}$ and $V_{CB}$ will both be equal to voltage $V_{tT}$. Setting $V_{tT}$ equal to $V_{CA}$ and $V_{CB}$ in equations (2) and (3) for each circuit, the following equation (4) is obtained:

$$V_{CB}(t_T) = V_{CA}(t_T), \text{ or}$$

$$\frac{R_1}{R_1 + R_2}\left(\frac{1}{\tau_A}\right)\left[1 - e^{-\left(\frac{t}{\tau_A}\right)}\right]V_1 = \frac{R_3}{R_3 + R_4}\left(\frac{1}{\tau_B}\right)\left[1 - e^{-\left(\frac{t}{\tau_B}\right)}\right]V_1 \quad (4)$$

Because the applied voltage $V_1$ which is related to the line voltage can be canceled from equation (4), it is evident that the solution $t=t_T$ of equation (4) is independent of $V_1$. If $V_1$ is approximated as a constant voltage, then the solution $t=t_T$ is also independent of line voltage frequency. Since $V_1$ is an approximation, although the solution is a slight function of line voltage frequency, it may be considered as substantially independent of line voltage frequency. For example, for a variation in line frequency from 60 Hz to 50 Hz which is about a 17% drop, only a 4% variation in delay time was noted.

Thus the circuit 200 delivers a triggering current through a current limiting resistor $R_5$ to generate the control signal 130 to the base of transistor 126 based on a comparison of the two voltages $V_{CA}$ and $V_{CB}$ which results in a trigger delay which is independent of the magnitude of the applied voltage 108 (which is associated with the line voltage). In addition, in one exemplary aspect of the invention, a programmable unijunction transistor (PUT) 212 is employed as a comparator circuit to compare the two voltages $V_{CA}$ and $V_{CB}$ and trigger the base of transistor 126 when $V_{CA}$ (210) reaches the reference voltage $V_{CB}$ (208). Other components or circuits, however, may also be employed and such alternative comparison components are contemplated as falling within the scope of the present invention.

The amount of the delay provided by the circuit 200 of FIG. 8 can be controlled by the values provided by $R_1$, $R_2$, $R_3$, $R_4$, $C_1$ and $C_2$, respectively. For example, with $R_1$=680 kΩ, $R_2$=2 MΩ, $R_3$=10 kΩ, $R_4$=25 kΩ, $C_1$=470 nF, and $C_2$=220 μF, a time delay of about 3.6 seconds is provided. A delay of 3.6 seconds provides sufficient delay to allow the air flow at the combustion head to sufficiently stabilize, and allows the desired pump pressure to be fully established when the actuated solenoid valve permits fuel oil to be delivered to the nozzle for ignition thereof. In addition, the time interval is safely distanced away from the safety time-out period, which in many control methodologies is about 15 seconds. Although a delay of 3.6 seconds is provided in the above example, it is to be appreciated that a variety of delay times may be employed and such variations are contemplated as falling within the scope of the present invention.

Figure 10:
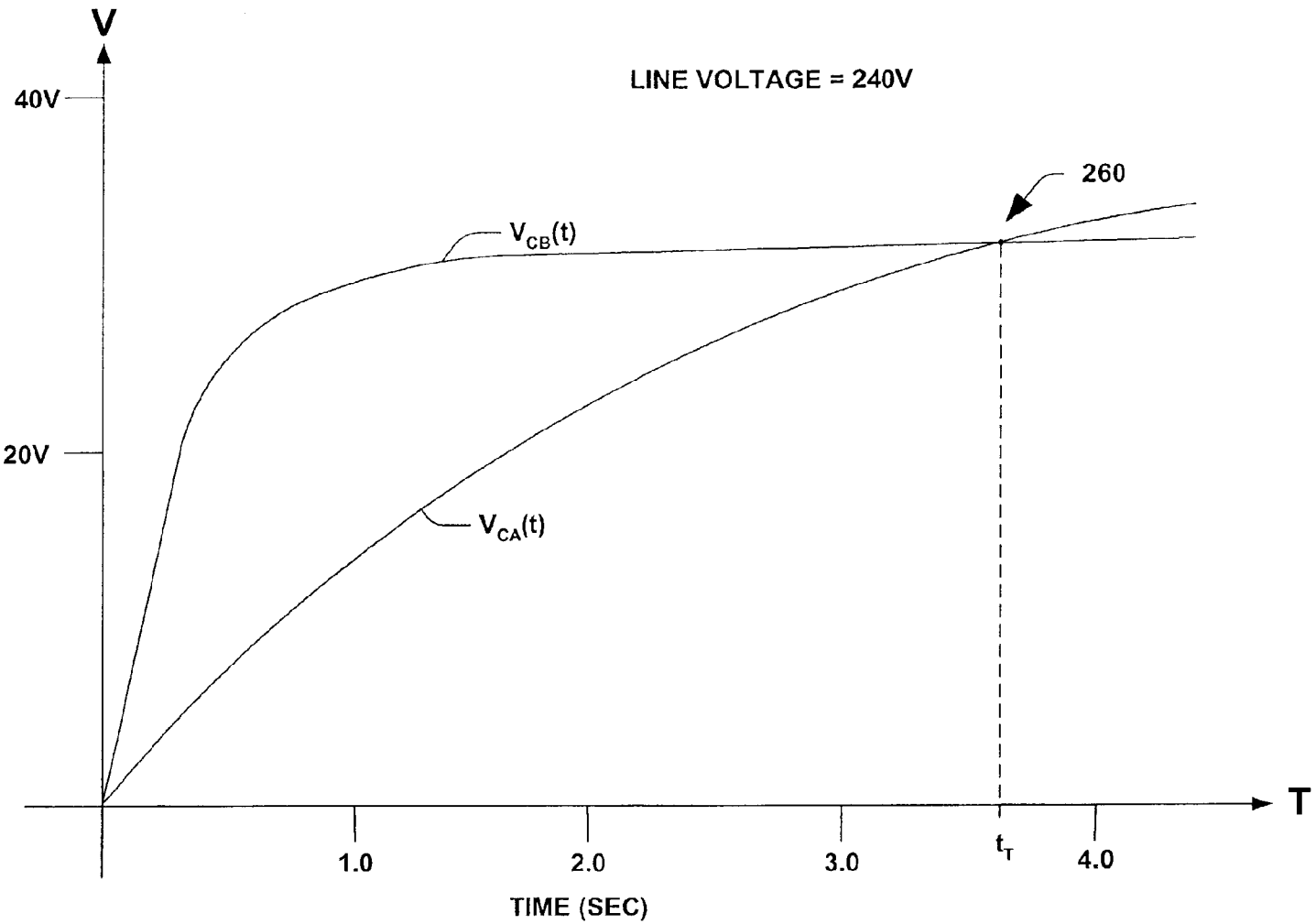
FIG. 10 is a graph illustrating signals on the output nodes of the two charging circuits of FIG. 8 for a 240V line voltage, and the delay time defined by when the signals are equal to one another according to the present invention.

Since the circuit 200 of FIG. 8 provides a time delay that is independent of line voltage, the present invention may be employed within oil burner systems that operate using differing line voltage specifications. For example, some applications and countries use a 240V line voltage, and the present invention provides the same time delay in such circumstances, as illustrated in FIG. 10 which illustrates a time delay of 3.6 seconds at time $t_T$ (260) wherein the input voltage 108 comprises a half-wave rectified 240V rms sinusoid. Note that in contrast with FIG. 9 (wherein the input voltage 108 comprises a half-wave rectified 120V rms sinusoid), the RC charging circuits 204 and 206 charge to different values (e.g., about 31V compared to about 15.5V in FIG. 9), however, since both $V_{CA}(t)$ and $V_{CB}(t)$ are both functions of the differing line voltage, the time delay ($t_T$) stays the same. Therefore the present invention further reduces cost over prior art solutions by allowing the same circuit to be employed, for example, in a cordset between the controller and the pump which integrates the solenoid valve therein for systems employing widely varying line voltages.

In addition to the above advantages, the circuit 200 of the present invention also provides a delay time that is substantially independent of temperature. Initially, the temperature coefficients of the components within the circuit are extremely low, thereby making variations in resistance and capacitance due to temperature variations small. Furthermore, to the extent that large variations in temperature do alter resistance and capacitance values, since the delay in the circuit 200 of FIG. 8 is a function of the time constants $\tau_A$ and $\tau_B$ and since such time constants will both increase and decrease together with changes in temperature, they will tend to be naturally compensated for, and thus causing the impact of temperature on the time delay to be negligible.

Figure 11:
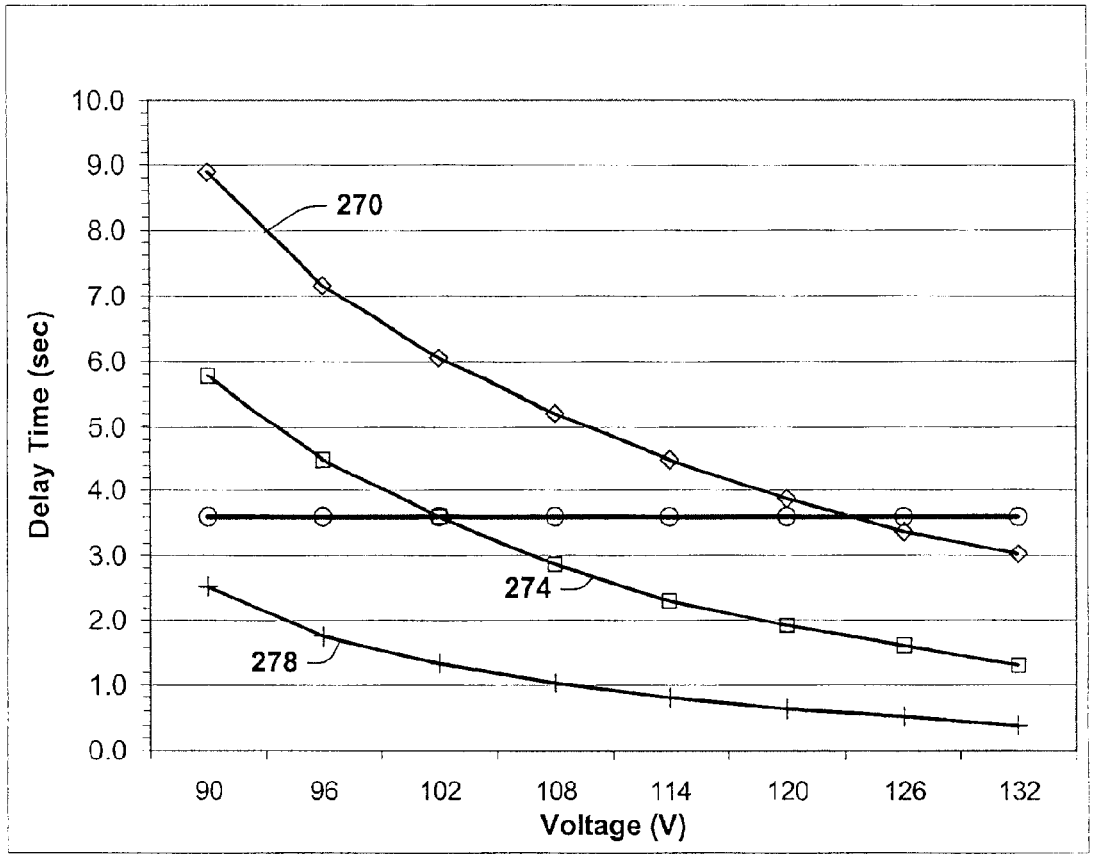
FIG. 11 is a graph illustrating the time delay of the circuit of FIG. 8 compared to prior art timers over variations in line voltage.

In order to further see the advantages of the present invention over the prior art, FIG. 11 is provided. FIG. 11 illustrates the variation in delay time provided by various prior art delay valves due to variations in line voltage. Note that in each of the prior art delay traces 270, 274, and 278, the variation in delay time varies by about a factor of three. In stark contrast, the present invention generates a delay time illustrated at 290 which is constant despite variations in the line voltage.

Figure 12:
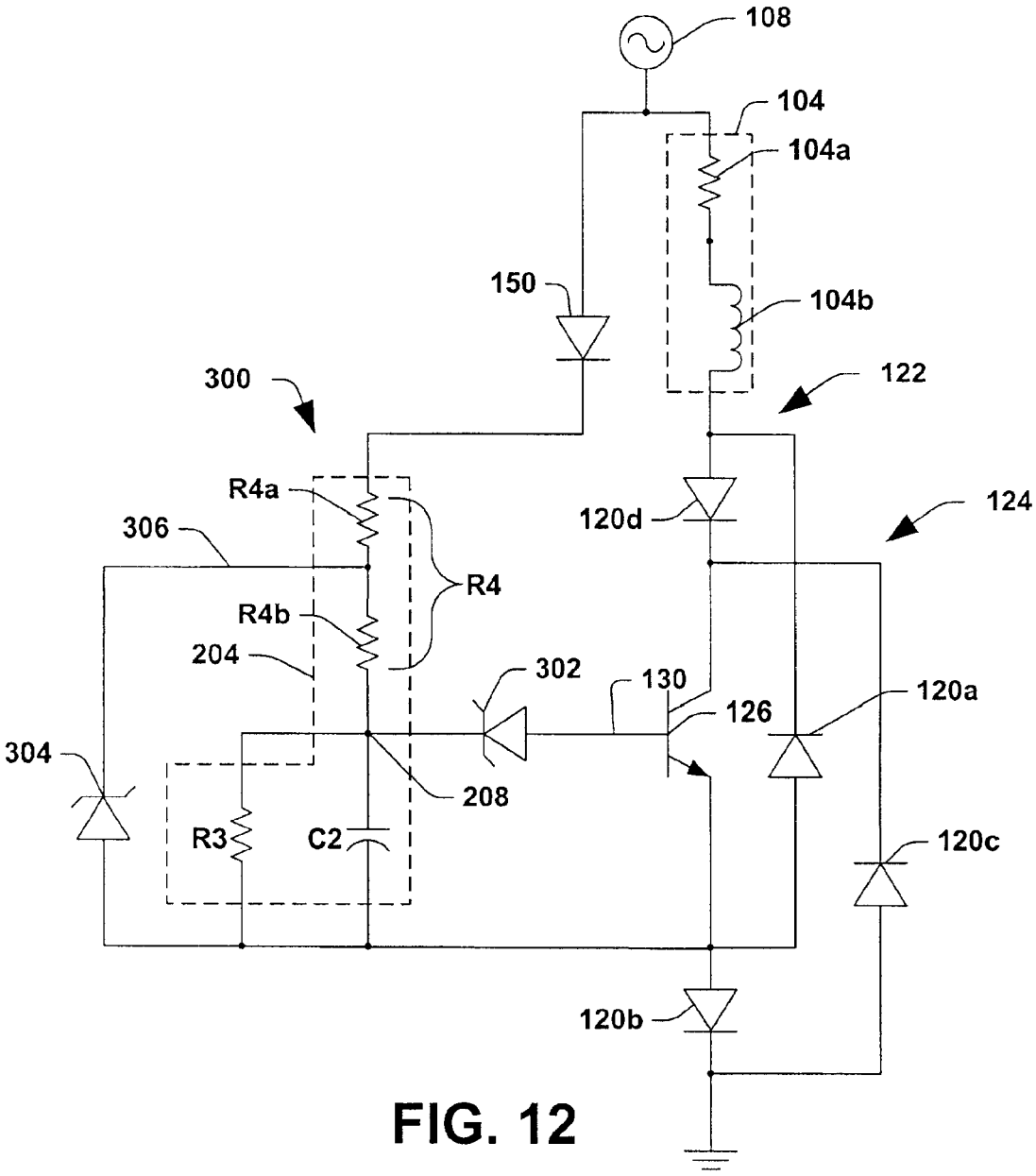
FIG. 12 is a schematic diagram illustrating another timer circuit for use in an oil burner system that provides a delay time that is substantially less dependent of variations in line voltage and temperature compared to prior art timers according to still another aspect of the present invention.

In accordance with another aspect of the present invention, a timer circuit is illustrated in FIG. 12 and designated at reference numeral 300. The timer circuit 300 includes the charging circuit 206 and a switch such as the transistor 126 operable to conduct based on the control signal 130. Similar to the timer circuit 200 of FIG. 8, the transistor 126 allows current to conduct through the bridge circuit 124, thereby actuating the solenoid valve 104 (the load). The charging circuit 206 has the charging node 210 that charges at a rate which is a function of $R_3$, $R_4$, $C_2$ and the half-wave rectified voltage $V_1$. The voltage at the node 210 is effectively compared to a reference voltage represented by the breakdown voltage of a zener diode 302. Upon zener breakdown, the zener diode 302 conducts, thereby providing current to the base of the transistor 126 for activation thereof.

The timer circuit 300 of FIG. 12 further comprises another zener diode 304 coupled across a portion of the charging circuit 206. The zener diode 304 has a substantially high zener breakdown voltage (e.g., 90V) that serves as a charging rate regulator for the charging circuit 206 at substantially high line voltages. For example, if the line voltage is a low or moderate voltage value, the breakdown voltage across the zener 304 may not be exceeded and the charging rate is dictated by $R_3$, $R_4$, $C_2$ and $V_1$ as discussed supra. However, at high line voltages, the rectified half-wave voltage $V_1$ will cause the voltage at node 210 to increase substantially more quickly and to a higher voltage value, thereby causing a substantial reduction in the delay time, which as discussed above, may be undesirable.

Figure 13:
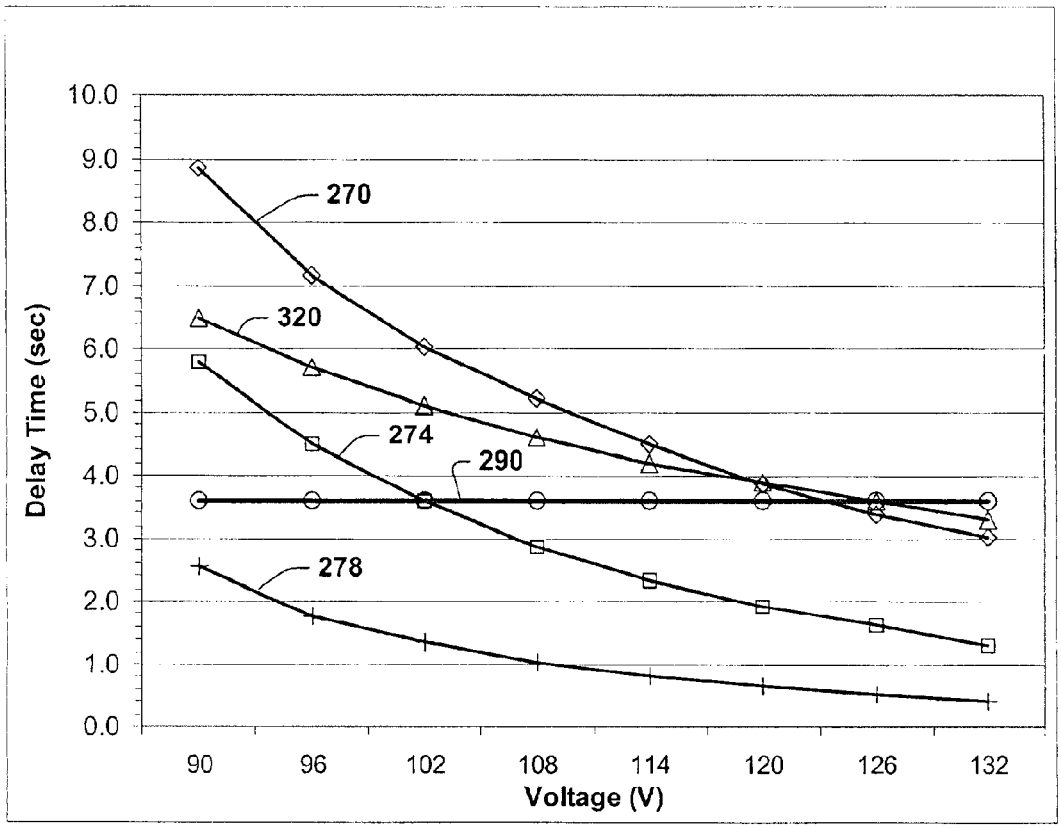
FIG. 13 is a graph illustrating the time delay of the circuit of FIG. 12 compared to prior art timers over variations in line voltage.

For high line voltages, the voltage at node 306 may exceed the breakdown voltage of the zener diode 304, thereby causing the zener to clamp the voltage thereat. The clamped voltage thus artificially alters the voltage involved in charging the node 210 so that the charging rate does not exceed a predetermined amount. In the above manner, the zener diode 304 serves as a compensation mechanism to regulate or modulate the charging rate of the charging circuit 206 for high line voltages. Accordingly, the time delay associated with the timer circuit 300 is less dependent on the line voltage than prior art solutions. For example, as illustrated in FIG. 13, the time delay associated with the timer circuit 300 is designated at 320. Note that although the time delay is not absolutely independent of line voltage variations, the timer circuit 300 is substantially less dependent of line voltage compared to the prior art (270, 274, and 278), wherein a time delay of about 3× over the illustrated line voltage range is reduced to less than about 2×.

Figure 14:
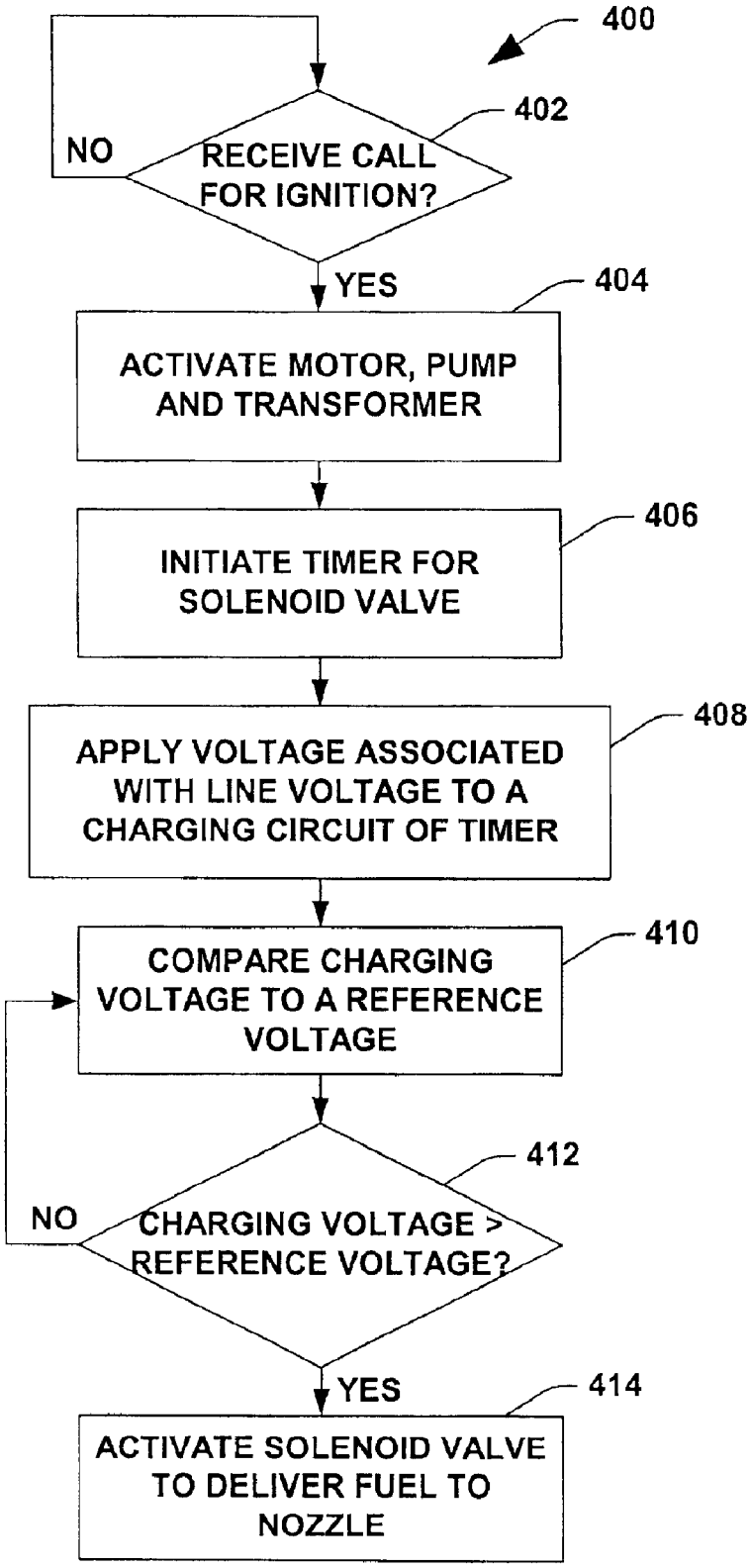
FIG. 14 is a flow chart illustrating a method of initiating combustion in an oil burner system using a timer circuit that provides a delay time for delivery of fuel oil to the nozzle that is substantially independent of line voltage and/or temperature according to still another aspect of the present invention.

According to another aspect of the present invention, a method of generating a time delay that is substantially independent of variations in line voltage and temperature is provided. Referring now to FIG. 14, an exemplary method 400 is illustrated for generating such a time delay. While the exemplary method 400 is illustrated and described herein as a series of acts or events, it will be appreciated that the present invention is not limited by the illustrated ordering of such acts or events, as some steps may occur in different orders and/or concurrently with other steps apart from that shown and described herein, in accordance with the invention. In addition, not all illustrated steps may be required to implement a methodology in accordance with the present invention. Moreover, it will be appreciated that the method 400 may be implemented in association with the apparatus and systems illustrated and described herein as well as in association with other systems not illustrated.

The method 400 begins at 402 with a controller awaiting a call for ignition. For example, a thermostat associated with an oil burner system may sense a temperature that has fallen below a predetermined threshold, thereby triggering a call for heat. When a call for ignition is received at the controller at 402 (YES), the controller sends out one or more control signals to activate the motor, pump and transformer or ignition device at 404. For example, the controller will activate a motor to initiate air flow and begin driving the pump to achieve a desired pressure therein. In addition, the controller activates a transformer or ignition device for generation of an arc via electrodes for ignition at 404.

Further, the controller also generates a control signal for initiation of a timer circuit for activation of a solenoid valve at 406. For example, the solenoid valve may be integrated with the pump and the solenoid valve is operable to open and close to facilitate selective delivery of fuel oil from the pump to the nozzle at the head via a fuel or nozzle line. The timer is operable to receive the control signal from the controller and activate the solenoid valve a predetermined period of time thereafter. Furthermore, the delay time provided by the timer is substantially independent of variations in line voltage and temperature. In accordance with one exemplary aspect of the present invention, the timer circuitry is employed within a cord set that is coupled between the controller and the solenoid valve that may be integrated with the pump. Accordingly, the timer circuit does not take additional space or add further complexity to the oil burner system.

The timer circuit is activated by applying a voltage thereto (that is associated with the line voltage) at 408. For example, if the controller couples the line voltage via the cord set to the circuitry, a diode may act as a half-wave rectifier and deliver the rectified voltage (which is a function of the line voltage) to other circuitry in the timer, such as a charging circuit portion. Such an application causes the charging circuit to charge a node from a first voltage potential to a second voltage potential at a rate that is a function of the line voltage. In accordance with one aspect of the present invention, if the line voltage is above a predetermined level, the charging rate may be modulated to make the charging rate less dependent on the line voltage. For example, a clamping circuit may be coupled in parallel to a portion of the charging circuit and operate to clamp a voltage thereacross if the line voltage exceeds a predetermined amount. In such a manner, the rate of charging is modulated based on the magnitude of the line voltage.

A charged node associated with the charging circuit is then compared to a reference voltage at 410. Once the charged node exceeds the reference voltage (YES at 412), a control signal is generated that serves to activate the solenoid valve. For example, a control signal may be generated to turn on a transistor associated with a bridge circuit to activate the solenoid valve at 414.

In accordance with another aspect of the present invention, the reference voltage is a voltage which is also a function of the line voltage. For example, another charging circuit may be employed having a node which charges at a rate dictated by a time constant which is different from the first charging circuit. In such an example, a comparator circuit can be employed to detect when the voltages of the two charging circuits are equal, and use such detection to define a time delay for the timer circuit. Since both charging circuits are a function of the line voltage, variations in line voltage are experienced by both circuits, thereby decreasing or eliminating altogether the impact of line voltage on the delay time.

Although the invention has been shown and described with respect to a certain aspect or various aspects, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several aspects of the invention, such feature may be combined with one or more other features of the other aspects as may be desired and advantageous for any given or particular application. Furthermore, to the extent that the term "includes" is used in either the detailed description or the claims, such term is intended to be inclusive in a manner similar to the term "comprising."

What is claimed is:

1. An oil burner system comprising an electric cord set comprising a first end coupled to a controller and a second end comprising a plug housing portion coupled to a valve associated with a pump, the electric cord set operable to activate a solenoid valve associated with the pump, the plus housing portion of the electric cord set comprising a voltage or temperature independent timer circuit therein, wherein the timer circuit is operable to activate the solenoid valve a predetermined period of time after a call for ignition signal is generated by the controller, wherein the predetermined time period is substantially constant with respect to variations in line voltage or in an ambient temperature in which the oil burner system resides.

2. The oil burner system of claim 1, wherein the timer circuit further comprises:

a bridge circuit having an input coupled to the solenoid valve, the bridge circuit adapted to receive a sinusoidal line voltage signal at the input and provide a rectified voltage signal at an output thereof;

a switch associated with the bridge circuit, and operable to permit current flow through the bridge circuit upon a closing of the switch, and further operable to prohibit current flow through the bridge circuit upon an opening of the switch; and a substantially voltage independent trigger circuit operable to receive a control signal associated with the call for ignition signal from the controller and output an activation output signal to close the switch a predetermined time period after the control signal, wherein the predetermined time period is substantially independent of variations in the line voltage supplied to the oil burner system.

3. An oil burner system having an electric cord set coupled between a controller and a valve associated with a pump, the electric cord set operable to activate a solenoid valve associated with the pump, the electric cord set comprising a voltage or temperature independent timer circuit operable to activate the solenoid valve a predetermined period of time after a call for ignition signal is generated by the controller, wherein the predetermined time period is substantially constant with respect to variations in line voltage or in an ambient temperature in which the oil burner system resides, wherein the timer circuit further comprises:

a bridge circuit having an input coupled to the solenoid valve, the bridge circuit adapted to receive a sinusoidal line voltage signal at the input and provide a rectified voltage signal at an output thereof;

a switch associated with the bridge circuit, and operable to permit current flow through the bridge circuit upon a closing of the switch, and further operable to prohibit current flow through the bridge circuit upon an opening of the switch; and a substantially voltage independent trigger circuit operable to receive a control signal associated with the call for ignition signal from the controller and output an activation output signal to close the switch a predetermined time period after the control signal, wherein the predetermined time period is substantially independent of variations in the line voltage supplied to the oil burner system, wherein the voltage independent trigger circuit further comprises:

a comparator circuit operable to compare two signals at inputs and output a signal to the switch based on the comparison;

a reference voltage circuit operable to generate a reference voltage which is a function of the line voltage, wherein the reference voltage is coupled to a first input of the comparator circuit; and a line voltage dependent charging circuit operable to charge an output node between a first voltage potential and a second voltage potential at a rate which is a function of the line voltage, wherein the output node is coupled to a second input of the comparator circuit.

4. The oil burner system of claim 3, wherein the reference voltage of the reference voltage circuit and the charging rate of the line voltage dependent charging circuit are both a positive function of the line voltage, wherein an increase in the line voltage causes the reference voltage to increase and the charge rate to increase, respectively.

5. The oil burner system of claim 3, wherein the predetermined time period is determined by when the output node of the line voltage dependent charging circuit exceeds the reference voltage.

6. The oil burner system of claim 5, wherein the predetermined time period is substantially independent of line voltage by having a variation in the reference voltage caused by a variation in the line voltage compensated by a corresponding change in the charging rate of the output node of the line voltage dependent charging circuit.

7. An oil burner system having an electric cord set coupled between a controller and a valve associated with a pump, the electric cord set operable to activate a solenoid valve associated with the pump, the electric cord set comprising a voltage or temperature independent timer circuit operable to activate the solenoid valve a predetermined period of time after a call for ignition signal is generated by the controller, wherein the predetermined time period is substantially constant with respect to variations in line voltage or in an ambient temperature in which the oil burner system resides, wherein the timer circuit further comprises:

a bridge circuit having an input coupled to the solenoid valve, the bridge circuit adapted to receive a sinusoidal line voltage signal at the input and provide a rectified voltage signal at an output thereof;

a switch associated with the bridge circuit, and operable to permit current flow through the bridge circuit upon a closing of the switch, and further operable to prohibit current flow through the bridge circuit upon an opening of the switch; and a substantially voltage independent trigger circuit operable to receive a control signal associated with the call for ignition signal from the controller and output an activation output signal to close the switch a predetermined time period after the control signal, wherein the predetermined time period is substantially independent of variations in the line voltage supplied to the oil burner system, wherein the voltage independent trigger circuit comprises:

a comparator circuit having a first and second input and one output, and operable to compare two signals at the inputs and provide a signal at the output which is based on a comparison of the two input signals;

a first charging circuit having an output node coupled to the first input of the comparator circuit, and operable to charge between a first voltage potential and a second voltage potential at a first charging rate; and a second charging circuit having an output node coupled to the second input, and operable to charge between a third voltage potential and a fourth voltage potential at a second charging rate which is greater than the first charging rate, and wherein the second voltage is greater than the fourth voltage.

8. The oil burner system of claim 7, wherein the first charging circuit comprises:

a first resistor having a first terminal and a second terminal;

a first capacitor having a first terminal and a second terminal, and coupled in parallel with the first resistor; and a second resistor having a first terminal and a second terminal, the second terminal coupled to the first terminals of the first resistor and the first capacitor, respectively, and forming a first charging node thereat, and wherein the first charging rate at the first charging node is a function of a resistance of the first and second resistors, a capacitance of the first capacitor, and the line voltage.

9. The oil burner system of claim 8, wherein the second charging circuit comprises:

a third resistor having a first terminal and a second terminal;

a second capacitor having a first terminal and a second terminal, and coupled in parallel with the third resistor; and a fourth resistor having a first terminal and a second terminal, the second terminal coupled to the first terminals of the third resistor and the second capacitor, respectively, and forming a second charging node thereat, and wherein the second charging rate at the second charging node is a function of a resistance of the third and fourth resistors, a capacitance of the second capacitor, and the line voltage.

10. The oil burner system of claim 9, wherein the first and second charging rates are both functions of the line voltage in the same manner, thereby making a comparison of the voltage at the first and second charging nodes substantially independent of the line voltage.

11. The oil burner system of claim 10, further comprising a half-wave rectification circuit coupled between the sinusoidal line voltage signal and the first and second charging circuits, respectively, wherein the half-wave rectification circuit is operable to half-wave rectify the sinusoidal line voltage signal input to the first and second charging circuits; and wherein the first and second charging circuits are operable to minimize a ripple associated with a charging voltage of the first and second charging circuits, respectively, thereby making the predetermined time period substantially independent of a frequency of the sinusoidal line voltage signal.

12. The oil burner system of claim 7, wherein the comparator circuit comprises a programmable unijunction transistor.

13. An oil burner system comprising an electric cord set coupled between a controller and a valve associated with a pump, the electric cord set operable to activate a solenoid valve associated with the pump, the electric cord set comprising a voltage or temperature independent timer circuit operable to activate the solenoid valve a predetermined period of time after a call for ignition signal is generated by the controller, wherein the predetermined time period is substantially constant with respect to variations in line voltage or in an ambient temperature in which the oil burner system resides, wherein the timer circuit further comprises:

a full-bridge circuit having an input coupled to the solenoid valve, the full-bridge circuit adapted to receive a sinusoidal line voltage signal at the input and provide a full-wave rectified voltage signal at an output thereof;

a switch associated with the full-bridge circuit, and operable to permit current flow through the full-bridge circuit upon a closing of the switch, and further operable to prohibit current flow through the full-bridge circuit upon an opening of the switch; and a substantially voltage independent trigger circuit operable to receive a control signal associated with the call for ignition signal from the controller and output an activation output signal to close the switch a predetermined time period after the control signal, wherein the predetermined time period is substantially independent of variations in the line voltage supplied to the oil burner system.

* * * * *

UNITED STATES PATENT AND TRADEMARK OFFICE

CERTIFICATE OF CORRECTION

PATENT NO. : 6,929,465 B1
DATED : August 16, 2005
INVENTOR(S) : John G. Graham and Victor J. Turk It is certified that error appears in the above-identified patent and that said Letters Patent is hereby corrected as shown below:

Column 12,
Line 11, please replace the word "plus" with the word -- plug --.

Signed and Sealed this

Thirteenth Day of December, 2005

JON W. DUDAS
*Director of the United States Patent and Trademark Office*